US007106285B2

(12) United States Patent
Naugler

(10) Patent No.: US 7,106,285 B2
(45) **Date of Patent: *Sep. 12, 2006**

(54) METHOD AND APPARATUS FOR CONTROLLING AN ACTIVE MATRIX DISPLAY

(75) Inventor: W. Edward Naugler, Escondido, CA (US)

(73) Assignee: Nuelight Corporation, Santa Clara, CA (US)

( * ) Notice: Subject to any disclaimer, the term of this patent is extended or adjusted under 35 U.S.C. 154(b) by 130 days.

This patent is subject to a terminal disclaimer.

(21) Appl. No.: 10/872,344

(22) Filed: Jun. 17, 2004

(65) Prior Publication Data

US 2004/0257355 A1 Dec. 23, 2004

Related U.S. Application Data

(63) Continuation-in-part of application No. 10/841,198, filed on May 6, 2004.

(60) Provisional application No. 60/532,034, filed on Dec. 22, 2003, provisional application No. 60/523,396, filed on Nov. 19, 2003, provisional application No. 60/479,342, filed on Jun. 18, 2003.

(51) Int. Cl.
*G09G 3/36* (2006.01)

(52) U.S. Cl. ..... 345/87; 345/76

(58) Field of Classification Search ..... 345/83, 345/84, 90–94, 97–100, 204, 76–82, 87–88; 315/169.1, 169.3; 348/800; 400/139
See application file for complete search history.

(56) References Cited

U.S. PATENT DOCUMENTS

| | | | |
|---|---|---|---|
| 4,655,552 | A | 4/1987 | Togashi |
| 6,320,325 | B1 | 11/2001 | Cok |
| 6,441,560 | B1 | 8/2002 | Hunter |
| 6,489,631 | B1 | 12/2002 | Young |
| 6,501,230 | B1 | 12/2002 | Feldman |
| 6,518,962 | B1 | 2/2003 | Kimura |
| 6,542,138 | B1 | 4/2003 | Shannon |

*Primary Examiner*—Nitin Patel
(74) *Attorney, Agent, or Firm*—Howrey LLP; Vinay V. Joshi

(57) ABSTRACT

A method of controlling an array of pixels in an active matrix display to a predetermined emission level is provided. The pixels are arranged in a plurality of rows and a plurality of columns, each pixel having an active matrix element. The method makes use of a plurality of sensors each having a measurable sensor parameter and at least one pixel driver. Light emission is varied from a plurality of pixels in a first row using the pixel driver and the active matrix elements in the pixels. Light emission is received from the pixels at the sensors and a measured value of the measurable sensor parameter is obtained responsive to the received light emission. For each of the plurality of pixels, a control signal is generated for the pixel to maintain constant emission from the light source at the predetermined emission level.

30 Claims, 8 Drawing Sheets

METHOD AND APPARATUS FOR CONTROLLING AN ACTIVE MATRIX DISPLAY

CROSS-REFERENCE TO RELATED APPLICATIONS

The present application claims the benefit of the filing date under 35 U.S.C. §119(e) of U.S. Provisional Application Ser. No. 60/479,342 filed 18 Jun. 2003 entitled "Emission Feedback Stabilized Flat Panel Display", U.S. Provisional Application Ser. No. 60/523,396 filed 19 Nov. 2003 entitled "Passive Matrix Emission Stabilized Flat Panel Display", and U.S. Provisional Application Ser. No. 60/532,034, filed 22 Dec. 2003, entitled "Stabilized Flat Panel Display", all of which are incorporated herein by reference in their entirety.

The present application is a continuation-in-part of U.S. patent application Ser. No. 10/841,198 filed May 6, 2004 entitled "Method and Apparatus for Controlling Pixel Emission," incorporated herein by reference.

TECHNICAL FIELD

The present invention relates generally to displays, and more particularly, to control of the gray-level or color and brightness of active matrix displays and picture elements of such displays.

BACKGROUND OF THE INVENTION

Flat panel displays typically convert image data into varying voltages fed to an array of picture elements (pixels) causing the pixels to either pass light from a backlight as in a liquid crystal display (LCD), or to emit light as in for example an electroluminescent, LCD display, or organic light emitting diode (OLED) display. The image voltages determine the amount of light from the pixel. Active matrix displays generally include an array of pixels arranged in a row-and-column format, each pixel contains a sample and hold circuit plus, in the case of pixel light emission displays, a power thin film transistor (TFT). One advantage of the active matrix is that each line of the display is held on for the full frame length so that the instantaneous brightness of the pixels is close to the average brightness. This is not true of passive displays since they are on only one line at a time; therefore, each line must have an instantaneous brightness equal to the average brightness multiplied by the number of lines. The active matrix display generally has a longer life time, lower power consumption and is capable of many times the line capability of the passive display. In general all full color monitor, laptop and video flat panel displays employ the active matrix while low resolution monochromatic (area color—icons) are passive.

In the case of the active matrix OLED display, a voltage is placed on the gate of a power transistor in the pixel, which feeds current to the OLED pixel. The higher the gate voltage, the higher the current and the greater the light emission from the pixel. It is difficult to produce uniform pixels and even if such uniform pixels could be produced it is difficult to maintain uniformity during the lifetime of a display containing an array of such pixels. As a result of manufacturing tolerances, transistor current parameters typically vary from pixel to pixel. Also the amount of light emitted by the OLED material varies depending on the OLED's current-to-light conversion efficiency, the age of the OLED material, the environment to which individual pixels of the OLED-based display are exposed, and other factors. For example, the pixels at an edge of the OLED display may age differently than those in the interior near the center, and pixels that are subject to direct sunlight may age differently than those which are shaded or partially shaded. In an attempt to overcome the uniformity problem in emissive displays, several circuit schemes and methodologies are in use today. One scheme uses a current mirror at the pixel where, instead of image voltages, image currents are used to force a particular current through the power transistor feeding the OLED. Also circuits have been designed which test the power transistor threshold voltage and then add the image voltage to the threshold voltage, therefore, subtracting out the threshold voltage so that variances in threshold voltage do not vary the OLED brightness. These circuit schemes are complex, expensive to produce and have not been entirely satisfactory.

Any display that requires a large number of gray shades requires uniformity greater than one shade of gray. For example, a hundred shades of gray require a display uniformity of 1% in order to use one hundred brightness levels. For a thousand gray levels 0.1% brightness uniformity is desired. Since it is difficult, if not impossible, to have a mass production process that holds 0.1% uniformity in the thin film area, another means of forcing uniformity on the display must be found.

One previous approach was to use certain optical feed back circuits, providing a particular type of feedback from optical diodes or optical transistors in an attempt to provide data on the actual brightness of a pixel's light emission and use the fed back data to cause a storage capacitor to discharge, thus, shutting down the power transistor. This requires a photodiode placed at each pixel as well as a means of reacting to the data supplied by the photodiode. Each pixel must have the discharge circuit. Accordingly, each pixel must include a highly complex circuit. Further, the circuit elements themselves, including the photodiode all introduce variables, which introduce non-uniformity. Further this approach only tends to cause uniformity since bright pixels are shut down faster and dim pixels are left on longer, but no exact brightness level is measured or used as a reference.

A second approach added a blocking transistor to the optical diode that relied on the pixel reaching an equilibrium brightness determined by the pixel brightness, the optical response of the diode, and all the parameters that determine the current supplied by the power transistor during the write time of the image line. However, the equilibrium brightness is determined by all the parameters mentioned above and these parameters can vary from pixel to pixel. Therefore, the attempted correction was not pixel-specific and did not take into account the changes for each pixel over time. Another problem is that the particular feedback circuit and method can set the system into oscillations, which if not damped within the line write time, would leave the actual brightness and voltage undetermined at the point of write time cut off.

Accordingly, an apparatus, system. and method is needed that stabilizes a display but advantageously is not effected by variation in photodiodes or other circuit parameters. The apparatus, system, and method should preferably not allow the system to enter oscillation and should allow the full range of brightness to be used over the life of the display.

SUMMARY OF THE INVENTION

According to an aspect of the present invention, a method of controlling an array of pixels in an active matrix display to a predetermined emission level is provided. The pixels are arranged in a plurality of rows and a plurality of columns, each pixel having an active matrix element. The method makes use of a plurality of sensors each having a measurable sensor parameter and at least one pixel driver. Light emission is varied from a plurality of pixels in a first row using the pixel driver and the active matrix elements in the pixels. Light emission is received from the pixels at the sensors and a measured value of the measurable sensor parameter is obtained responsive to the received light emission. For each of the plurality of pixels, a control signal is generated for the pixel to maintain constant emission from the light source at the predetermined emission level.

DETAILED DESCRIPTION OF PREFERRED EMBODIMENTS

Embodiments of the present invention provide systems, methods, circuits, and apparatuses for controlling emission from a pixel. The emission source may be generally any source known in the art that produces radiation in response to a supplied voltage—including light emitting diodes and organic light emitting diodes at any wavelength including white organic light emitting diodes. In some embodiments, such as an LCD display, the light source is a backlight and light emission from the pixel is controlled by varying the amount of light from the backlight passed through the pixel. Other light sources may be used including electroluminescent cells, inorganic light emitting diodes, vacuum florescent displays, field emission displays and plasma displays. While radiation (or illumination) sources intended to display graphics, images, text, or other data or information for human viewing will primarily be in the visual wavelengths (generally about 400–700 nanometers) it is understood that the invention applies as well to shorter and longer wavelengths as well such as for example, but not limited to ultraviolet and infrared radiation.

Figure 1:
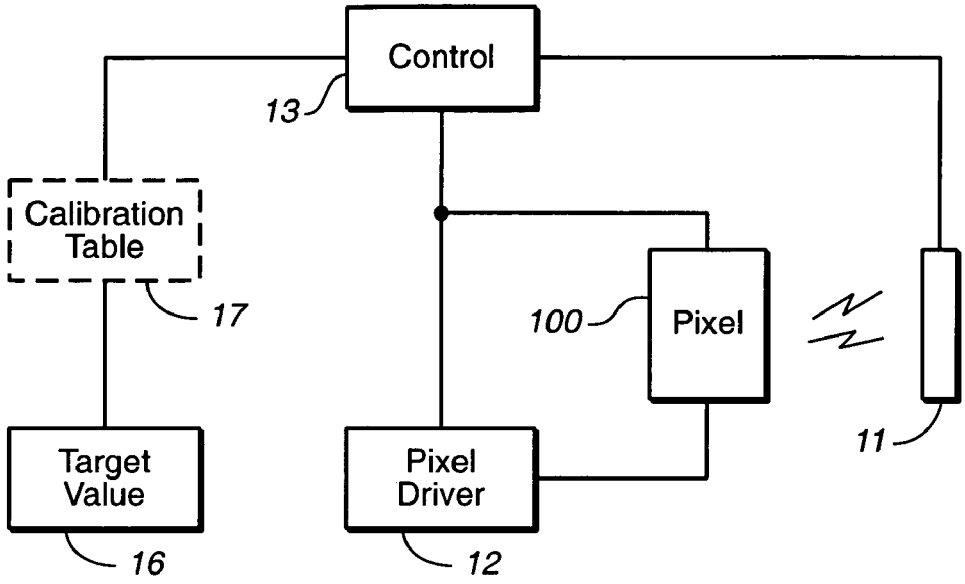
FIG. 1 is a schematic illustration of an apparatus according to an embodiment of the present invention.

Embodiments for controlling each pixel element are generally described in U.S. patent application Ser. No. 10/841,198 entitled "Method and Apparatus for Controlling Pixel Emission," filed 6 May 2004 incorporated herein by reference. Briefly, Emission from a pixel 100 is received by a sensor 11, as shown in FIG. 1. The sensor 11 can be any sensor suitable for receiving radiation from the pixel 100. The sensor 11 may be a photo-sensitive resistor. Other radiation- or light-sensitive sensors may also or alternatively be used including, but not limited to, optical diodes and/or optical transistors. The sensor 11 has at least one measurable parameter where the value of the measurable parameter is indicative of the radiation emission from the pixel 100. For example, the sensor 11 may be a photo-sensitive resistor whose resistance varies with the incident radiation level. The radiation or optically sensitive material used to form the photo-sensitive resistor may be any material that changes one or more electrical properties according to the intensity of radiation (such as the intensity or brightness or visible light) falling or impinging on the surface of the material. Such materials include but are not limited to amorphous silicon (a-Si), cadmium selenide (CdSe), silicon (Si), and Selenium (Se) for example.

The sensor 11 is coupled to a control unit 13, such that the control unit 13 receives or determines a value of the sensor's measurable parameter during operation of the pixel 100. A target value 16 is also coupled to the control unit 13 at node 36, allowing the control unit to compare the measurable sensor parameter and the target value 16. The control unit 13 generates a control signal based on this comparison to influence light emission from the pixel 100. The control unit 13 may be implemented in hardware, software, or a combination thereof. In one embodiment, the control unit 13 is implemented as a voltage comparator. Other comparison circuitry or software may also be used.

The target value 16 is representative of the desired emission of the pixel 100 and may take any form including but not limited to, a current value, a voltage value, a capacitance value, or a resistance value, suitable for comparison with the measurable sensor parameter.

The control unit 13 is coupled to a pixel driver 12. The pixel driver 12 is operable to develop a drive signal for the pixel 100 to determine the light emission from the pixel 100. The pixel driver 12 may include any hardware, software, firmware, or combinations thereof suitable for providing a drive signal to the pixel 100. The pixel driver 12 in some embodiments is located outside of the area of the pixel 100. That is, the pixel 100 may be formed on a display substrate, described further below. The pixel driver 12 is preferably located outside of the display area. The pixel driver 12 may be integrated with the display substrate, or may be separate from the display substrate. In some embodiments, portions of the pixel driver 12 are contained within the pixel 100. Embodiments of the present invention provide for coupling information from a sensor regarding light emission from the pixel 100 to the pixel driver 12.

In one embodiment, the pixel driver 12 varies the light emission from the pixel 100 until the measurable sensor parameter indicates that the target value 16 has been achieved. This may indicate that the values match to within a specified degree of certainty, or that the values have attained some predetermined relationship. The control unit 13 then couples a control signal to the pixel driver 12 to stop the variation of the light emission and maintain the light emission level. Accordingly, variations in the pixel 100 are accounted for, as the control unit 13 bases its comparison on the measurable sensor parameter of the sensor 11.

In some embodiments, variations in the sensor 11 may further optionally but advantageously be accounted for through use of a calibration table 17 coupled to the emission control 13 and the target value 16. The sensor 11 is calibrated such that one or more values of the measurable parameter are known for predetermined light intensity levels. Accordingly, in an embodiment where the sensor 11 is a photo-sensitive resistor, the resistance of the sensor is determined at one or more light levels of interest. Calibration procedures are described further below. The calibrated values 17 may be stored, for example, in a look-up table or other format in a memory or other storage device. The target value 16 is coupled to the calibration table 17 and a calibrated value is provided to the control unit 13 for comparison with the measurable sensor parameter of the sensor 11.

Based on the comparison, the control unit 13 couples a control signal to the pixel driver 12 that is varying emission of the pixel 100. In this manner, emission of the pixel 100 is controlled to a particular emission or brightness level, based on a known target value or calibration value of the sensor 11. Variations in fabrication or operation of the sensor 11 may be accounted for during the calibration process of the sensor, described further below. The operation of the light or radiation source 10 is controlled in that the radiation output is monitored and held at a level based on a target value of the measured sensor output.

Figure 2:
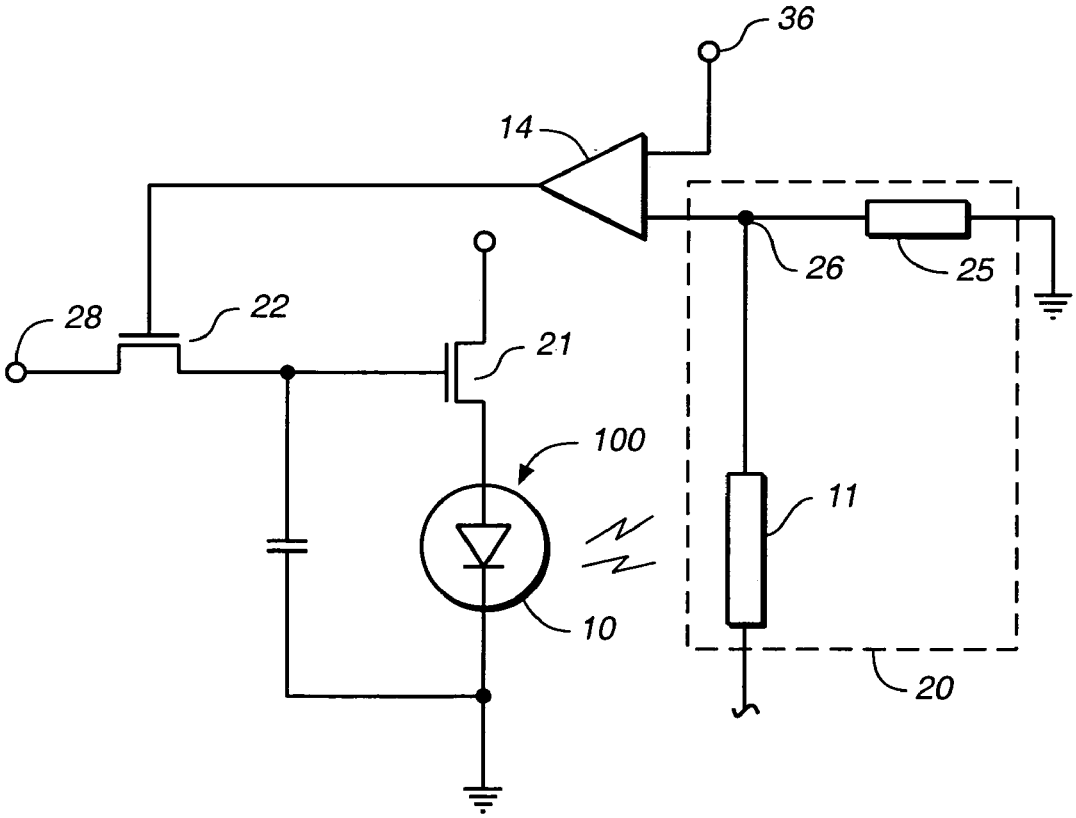
FIG. 2 is a schematic illustration of an implementation of the apparatus in FIG. 1, according to an embodiment of the present invention.

While components of an apparatus according to the invention are shown in FIG. 1, it is to be understood that the illustrated components may be implemented in a variety of ways. FIG. 2 illustrates one embodiment of an apparatus according to an embodiment of the present invention. In the embodiment shown in FIG. 2, the pixel 100 includes a light source 10 positioned to illuminate the sensor 11. The sensor 11 is a photo-sensitive resistor as shown in FIG. 2, but may also be a photo-sensitive diode or transistor, and may be implemented as shown in FIG. 2 in a voltage divider 20 with a second resistor 25. Accordingly, a voltage at node 26 changes as the brightness level of the radiation source 10 changes. The control unit 13 is implemented as a voltage comparator 14 coupled to the node 26 and the target value 16 at node 36. The target value 16 may be simply a target value or may be a target value adjusted by a calibration table, as described above. The target value 16 may be supplied by a memory or look-up table and provided node 36 of comparator 14. A power transistor 21 is coupled to the light source 10. The power transistor 21 regulates the current through light source 10. The gate of the power transistor 21 is coupled to a data transistor 22. The data transistor 22 forms part of the pixel driver 12. The gate of the data transistor 22 is coupled to an output of the voltage comparator 14.

In the embodiment shown in FIG. 2, the comparator 14 is configured to output a first signal to transistor 22, which turns on transistor 22 when the node 26 is at a lower voltage potential than the node 36. The comparator 14 is configured to output a second signal to transistor 22, which turns transistor 22 off when the voltage potential at node 26 is equal to or greater than the node 36. As a continuously varying voltage, such as a voltage ramp, is applied on the node 28, current through the light emitting diode 10 ramps up, increasing the light emission from the diode 10 and the radiation incident on the sensor 11, modifying the voltage at the node 26. When the emission of the diode 10 reaches the desired value, the voltage at the node 26 becomes equal to the voltage at the node 36, and the comparator 14 outputs the second signal, to transistor 22, which turns transistor 22 off, thus, stopping the increase of current through the diode 10. Storage capacitor 32 stores the voltage on the gate of power transistor 21, thus, maintaining the emission level at the desired brightness level.

In this manner, control is provided generally by varying the light emission from the light source 10 and halting the variation of the light emission when the measured sensor parameter indicates the target emission level has been attained. The light emission may be varied in any manner over time—including, for example, increasing or decreasing ramp, sinusoidal variations, square-wave variations, increasing or decreasing steps, or substantially any other variation with time. In some embodiments, the light emission is varied by turning the light source on and off, once or a plurality of times. Embodiments incorporating a ramp voltage (linear or nonlinear) are conveniently implemented and in some embodiments the ramp voltage can be generated by supplying a square wave voltage (a step voltage) where the voltage ramp is caused by the rise time due to the pixel circuitry's parasitic capacitances and resistances coupled with the storage capacitor and the gate capacitance of the power TFT.

The variation is halted when the value of the measurable sensor parameter indicates that the target emission level has been reached. Embodiments of the present invention accordingly control a light source using a system that does not have a settling time dependent on a particular circuit loop gain, as has been the case in conventional systems utilizing feedback circuits.

Figure 3A:
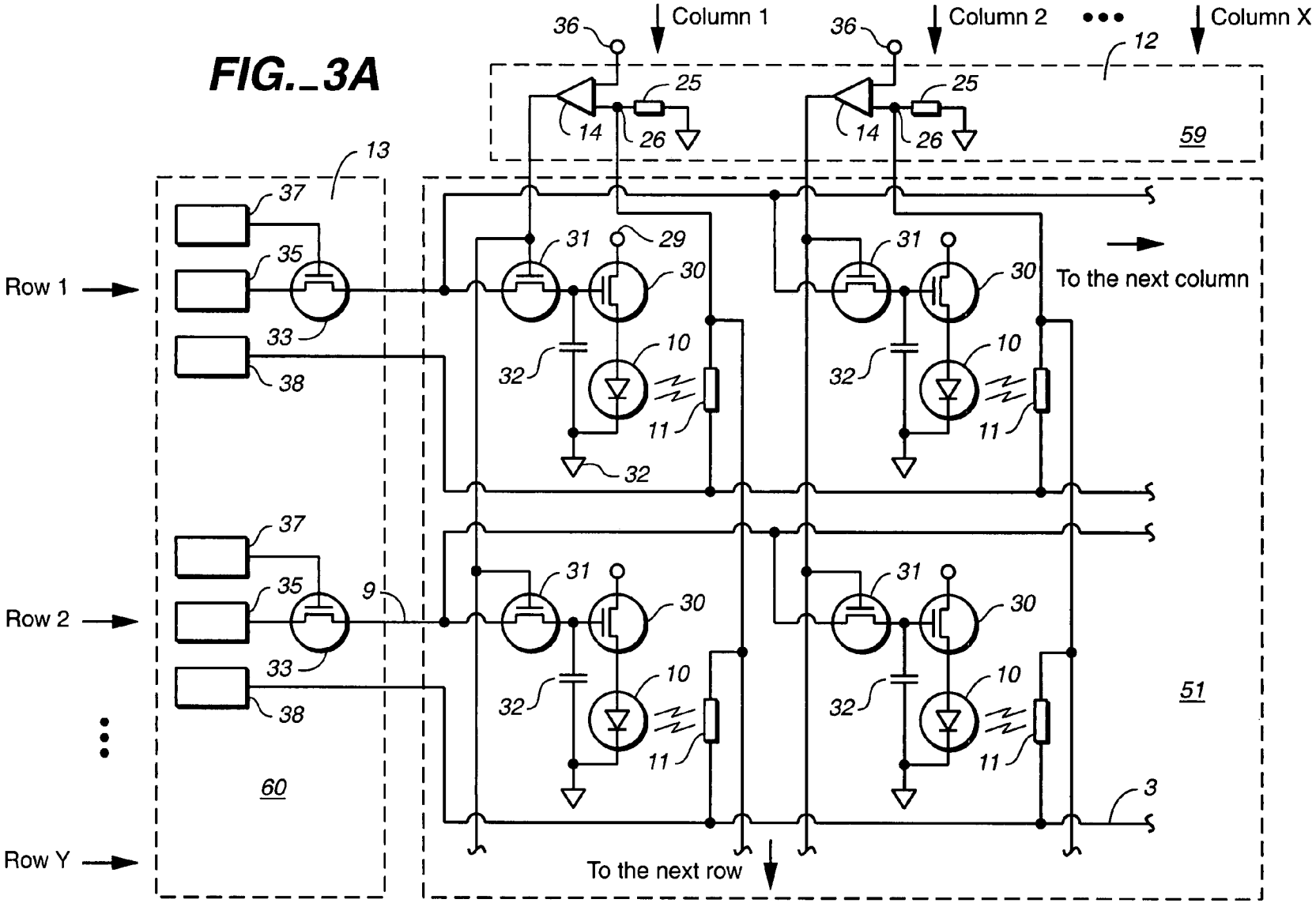
FIG. 3A is a schematic illustration of an actively addressed display according to an embodiment of the present invention.

Methods and apparatuses for stabilizing a light source according to embodiments of the invention may advantageously be used to control or stabilize one or a plurality of light sources in an electronic display. One embodiment of a controlled array of pixels in an active matrix display is illustrated in FIG. 3A. Although FIG. 3A depicts an exemplary embodiment, those skilled in the art will recognize that other design configurations may be employed to achieve the control mechanisms described. An array of the sensors 11 are positioned to capture radiation from an array of organic light emitting diodes OLEDs 10 or other light emitting elements, or any other light source, as described above. An array of active matrix (AM) pixel transistors 30, and 31, and storage capacitors 32 are coupled to the light sources 10 such that one pair of active matrix pixel transistors 30 and 31 drive each light source 10, along with a storage capacitor 32.

The light sources 10 are arranged in an array format shown in FIG. 3A where columns are labeled 1, 2, to x and rows are labeled 1, 2, to y. Although an orthogonal row-and-column layout is shown in FIG. 3A with an equal number of light sources in each row, and an equal number of light sources in each column, it is to be understood that the array of light sources may not be so ordered in other embodiments. There may be any number of rows and columns, and in some embodiments the rows and columns may not contain an equal number of light sources, and in some embodiments the rows and columns may not be orthogonal or may not lie in straight lines. In some embodiments, there may only be a single row or single column, or a sparsely populated array where not every row and column contains a pixel. Non-array configurations may also or alternately be implemented.

A plurality of sensors 11 are coupled to the voltage comparator 14. As shown in FIG. 3A, one voltage comparator 14 is coupled to all the sensors 11 in a single column (numbered 1, 2, to x). In some embodiments, a plurality of voltage comparators 14 may be provided for the sensors 11 in a column. A voltage ramp circuit 35 is provided coupled to the active matrix pixel transistors 31 in each row, as shown in FIG. 3A. Each light source with its AM elements 30, 31, and 32, and optical detector 11 is associated with a unique combination of voltage comparator 14 and ramp circuitry 35. That is, each light source 10 is identified by a unique row- and column-address, as shown in FIG. 3A.

Figure 4:
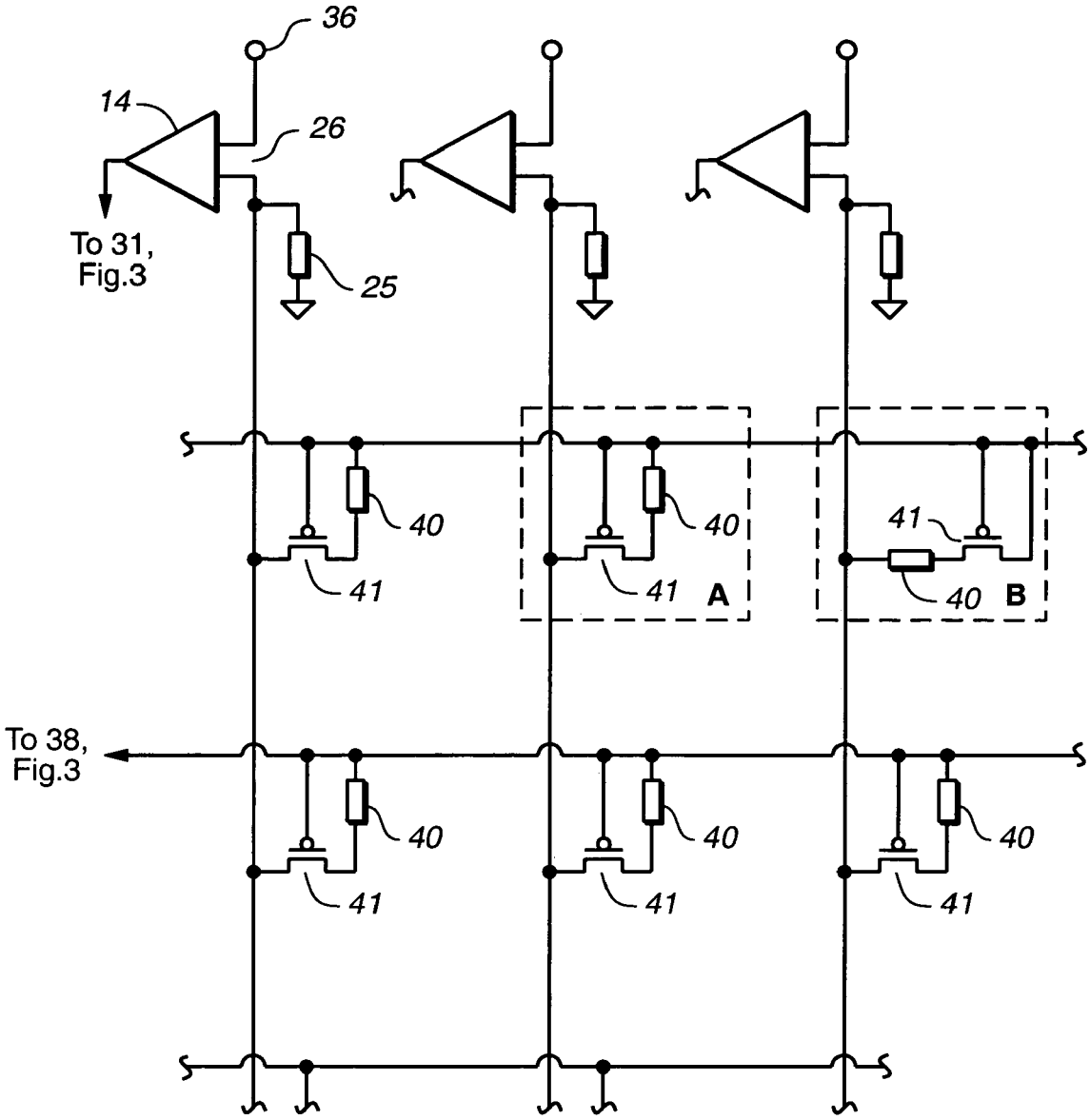
FIG. 4 is a schematic illustration of an array of sensors, according to an embodiment of the present invention.

The sensors 11 may be simple passive optical resistors for a linear array, but if more than a few rows are desired then an active array may be advantageous to reduce cross-talk among the sensors. Accordingly, one or more of the optical detectors 11 may include an optically sensitive resistor 40 coupled to a transistor 41, or a different switch, as shown in FIG. 4. The circuit of the sensor array can vary according to ways known in the art. Boxes A and B in FIG. 4 illustrate two methods of implementing the optical resistor 11 with the transistor 45.

The optical detectors are calibrated to determine the relationship between the measurable parameter—such as voltage across an optical resistor—and incident radiation. In this manner, the desired brightness level of each pixel may be correlated to a value of the measurable sensor parameter.

During operation, image data is written to a first row. A row is selected by applying voltage from voltage generator 37 to the gate of TFT 33 in the row being selected. Meanwhile all the TFT 33s in the other rows remain in the off state. An image datum is indicative of the desired brightness of the pixel and represents the value of the measurable sensor parameter needed to attain the desired brightness. In the embodiment shown in FIG. 3A, the image data are coupled to each node 36. Typically as each line is written to, any pre-existing voltage on the storage capacitor 32 is first erased by placing a voltage on the gates of transistors 31 and 33 and grounding ramp generator 35. Accordingly, voltage levels representing the desired brightness of each pixel in row one are down loaded to pin 36 of each voltage comparator 14 for a plurality of the columns in the display from 1, 2, . . . , x. In the embodiment shown in FIG. 3A, the voltage comparators 14 are designed to output a voltage that turns on the transistors 31 (+10 V in one embodiment) when the voltage on pin 26 is less than the voltage on pin 36. Therefore, the voltage comparator 14 delivers a turn-on voltage to each of the gates of the transistors 31. A voltage source 37 delivers a turn-off voltage to the gates of transistors 33, accordingly light emission does not begin through the light sources while the transistors 33 remain off.

When the voltage source 37 in row one places a turn-on voltage on the gate of the transistor 33 for row one, the ramp generator 35 begins to ramp the voltage applied to the drain of the transistor 33 in row one, and thus, the drain of the transistor 31, and thus, the voltage begins to rise on the storage capacitors 32 in row one and the gates of the transistors 30, in the first row only; and the voltage source 38 places a reference voltage (for example, +10 volts) on the voltage divider including the sensors 11 in row one. Although this description focused on the method during writing image data to row one, it is to be understood that any row may be written to using methods described herein.

Accordingly, voltage begins to ramp up on the gates of the power transistors 30 in row one, causing currents to flow through the light sources 10 in row one. Current also begins to flow through the sensors 11 and resistors 25 in row one. This causes the voltages to rise on pins 26 of the voltage comparators 14. As long as the resistance of the optical sensors 11 remains stable the voltages on pins 26 of voltage comparators 14 are stable and below the data voltages placed on pins 36 of the voltage comparators 14. Since, however, the OLEDs are increasing their light emission due to the ramp voltage from ramp generator 35 for row one, the resistance of optical detectors 11 in row one are decreasing according to the brightness of the illumination.

Due to the decrease in resistance of the optical sensors 11 in row one, the voltages on pins 26 of the voltage comparators 14 are increasing due to the higher current flows through resistors 25. The brightness of the pixels in row one determines the voltages on pins 26. When the voltage on pin 26 equals the data voltage placed on pin 36 the output voltage of the voltage comparator 14 switches from a turn-on voltage for the transistor 31 to a turn-off voltage for the transistor 31 (+10 volts to −10 volts, for example). At this point the brightness of each pixel in row one is determined by the data voltage placed on pins 36 of each of the voltage comparators 14.

When the voltage output of each of the voltage comparators 14 switches to a turn-off voltage (−10 Volts, in one embodiment) the gates of the transistors 21 are placed in the off condition and the ramp generator 35 is no longer able to increase the voltage on storage capacitor 32 and power transistor 30 thus, freezing the brightness of the pixel. The time allowed for all the pixels to reach the brightness determined by the data voltages placed on pins 30 of voltage comparators 25 is called the line scan time and is determined by the number of frames per second and the number of lines. For example, a frame rate of 60 fps takes 16.7 ms for each frame. If there are 1000 rows (lines), the line scan time is 16.7 microseconds (μs). Therefore, the display circuitry is advantageously designed so that the maximum brightness allowed (the top gray shade) is reached in less than 16.7 μs in one embodiment. Slower circuitry may also be used by altering the frame rate or number of rows. Other trade-offs in speed and accuracy may be made.

Once row one is completed, the row one light sources 10 are at their desired brightness with the desired gate voltage placed on the power transistors 30 and held by the storage capacitors 32. Voltage source 37 for row one is now switched to place the off voltage on the gate of transistors 33 for row one. Simultaneously, the ramp generator 35 for row one is optionally switched off and the voltage source 38 is switched to an off value, turning off the sensors 11 in row one. This completes the locking of the voltages placed on the gates and storage capacitors in row one regardless of the gate status of the transistors 31. A second row may now be controlled in an analogous manner to row one.

The brightness of each pixel accordingly depends on knowing or estimating the resistances of the optical resistor 11 and the ground resistor 25 coupled with the image data voltages. All variations in the transistors 31 and 30 do not influence the control, nor do the variations in the emission output versus current characteristics of the light sources 10, or the aging history of the light sources 10. Furthermore, the optical sensing circuit also gives information on the ambient light conditions, which can be used to adjust the overall brightness of the light source array to compensate for changing light conditions. If, for example, a shadow falls on one or more of the light sources 10 those sources in the shadow are dimmed, maintaining a uniform appearance of the display.

Figure 3B:
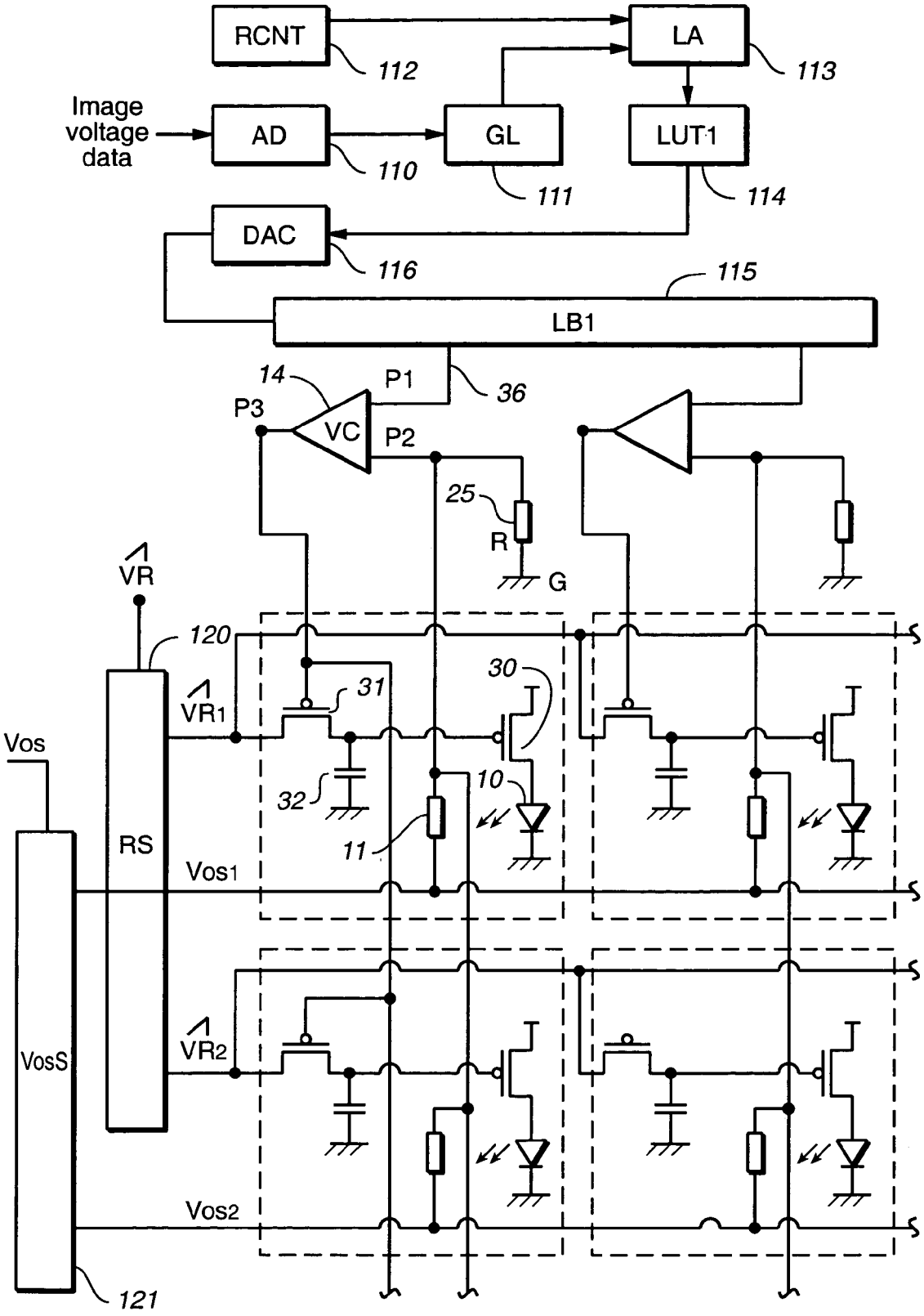
FIG. 3B is a schematic illustration of an actively addressed display including components providing a reference signal, according to an embodiment of the present invention.

FIG. 3B illustrates an embodiment of a system providing the reference voltage for the node 36 in FIG. 3A. Image data may be provided to an analog to digital converter (A/D) 110. The digital values may then be coupled to an optional grayscale level calculator 111 that determines a number of the grayscale level corresponding to the digital image data. In some embodiments, the grayscale level calculator 111 is not needed, and the output of the A/D converter 110 is indicative of the grayscale level. A row and column tracker unit 112 couples a line number and column number to a calibration look-up table addresser 113. The grayscale level calculator 111 further couples the grayscale level to the calibration look-up table addresser 113. The look-up table addresser 113 is coupled to a calibration lookup table 114 that includes calibration data. When the address is coupled to the look-up table 114, a reference number stored at the address is converted to an analog voltage by DAC 116 and is coupled to a line buffer 115 and then coupled to one or a plurality of reference pins on the voltage comparators 14 for one or a plurality of columns. In this manner, image data for a selected row is coupled to the voltage comparators. A voltage ramp line selector 120 is provided coupled to the pixels in each row. The row selector 120 selects a row and couples a voltage ramp to the pixels in the selected row. The voltage line selector 121 couples a voltage signal to the sensors in the selected row.

The embodiment shown in FIG. 3B may be used during "real-time", or continuous, control of a display, where image data are supplied to the pixels and the pixel brightnesses are continuously controlled to the image data values. In some embodiments, it may be advantageous to provide only periodic, or discrete, updating of the pixel brightness level. In such a periodic update system, image data from a lookup table is placed directly on the gate of the power transistor through the channel of the data transistor. Periodically, the display is scanned using the comparators to interrogate the pixels and adjust the signal supplied to the power transistor.

Figure 3C:
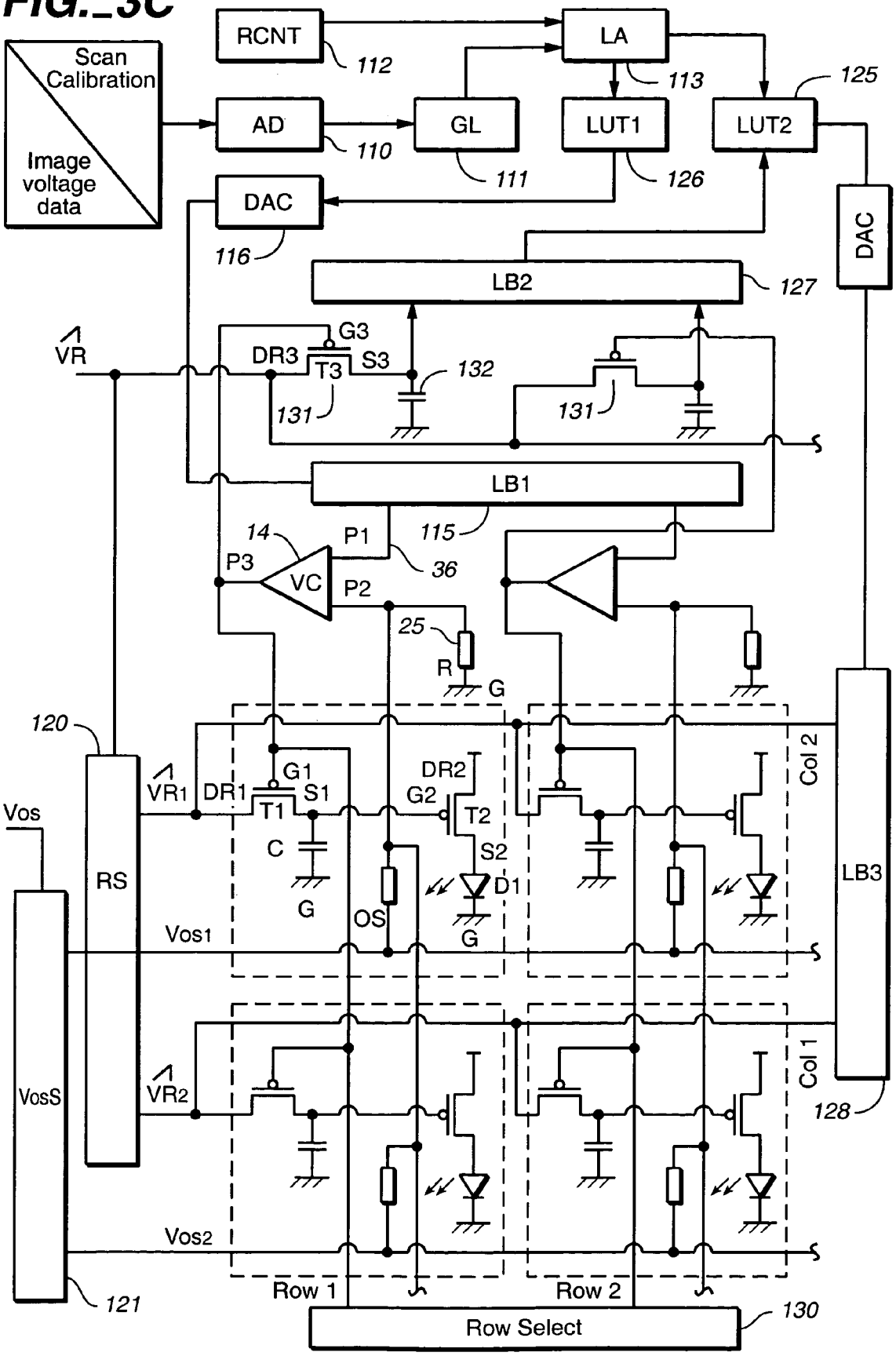
FIG. 3C is a schematic illustration of an actively addressed display for use with periodic calibration, according to an embodiment of the present invention.

An embodiment of a controlled display that may be periodically updated or controlled is shown in FIG. 3C. A drive signal to be applied to each pixel is stored in a look-up table 125. Drive signals are supplied to each pixel during operation using line buffer 128 and row selector 130. The row selector 130 selects a row as the drive signal for a pixel in the selected row is coupled from the line buffer 128. Initial values stored in the look-up table 125 may generally be determined through any suitable method. During operation of the display, a calibration may take place at generally any interval periodically or at random intervals, including only once. During a calibration phase, calibration data is supplied by look-up table 126 and provided to the comparators 14 using the line buffer 115, as described above with regard to FIG. 3B. The row selector 120 outputs a varying signal, such as a ramp to the selected row as well as to calibration transistors 131. As described above, comparators 14 are provided to halt the varying signal and maintain constant emission once the pixel's emission reaches the calibration level supplied to the comparator. In the embodiment shown in FIG. 3C, the value of the drive signal during constant emission is further stored in the line buffer 127 through the calibration transistors 131 and capacitors 132. During further operation of the display, calibrated image data is passed from line buffer 127 to the look-up table 125. The calibration procedure may occur at any frequency, or at random—including but not limited to once an hour, once a day, once a year, once per owner, once per environment or application. Alternatively, the calibration procedure could occur at the command of a user or administrator of the display.

The embodiment of a display shown in FIG. 3C may be integrated—that is components used during the calibration phase and during operation of the display may be packaged together. In some embodiments, components used during the calibration (such as the comparators 14, the row selector 120, the calibration transistors 131, and/or the line buffers 127 and 115) are brought into communication with the pixels during calibration mode only, and are not coupled to the pixels when calibration is not taking place. The calibration components may be provided, for example, on one or a plurality of additional integrated circuits.

Figure 5:
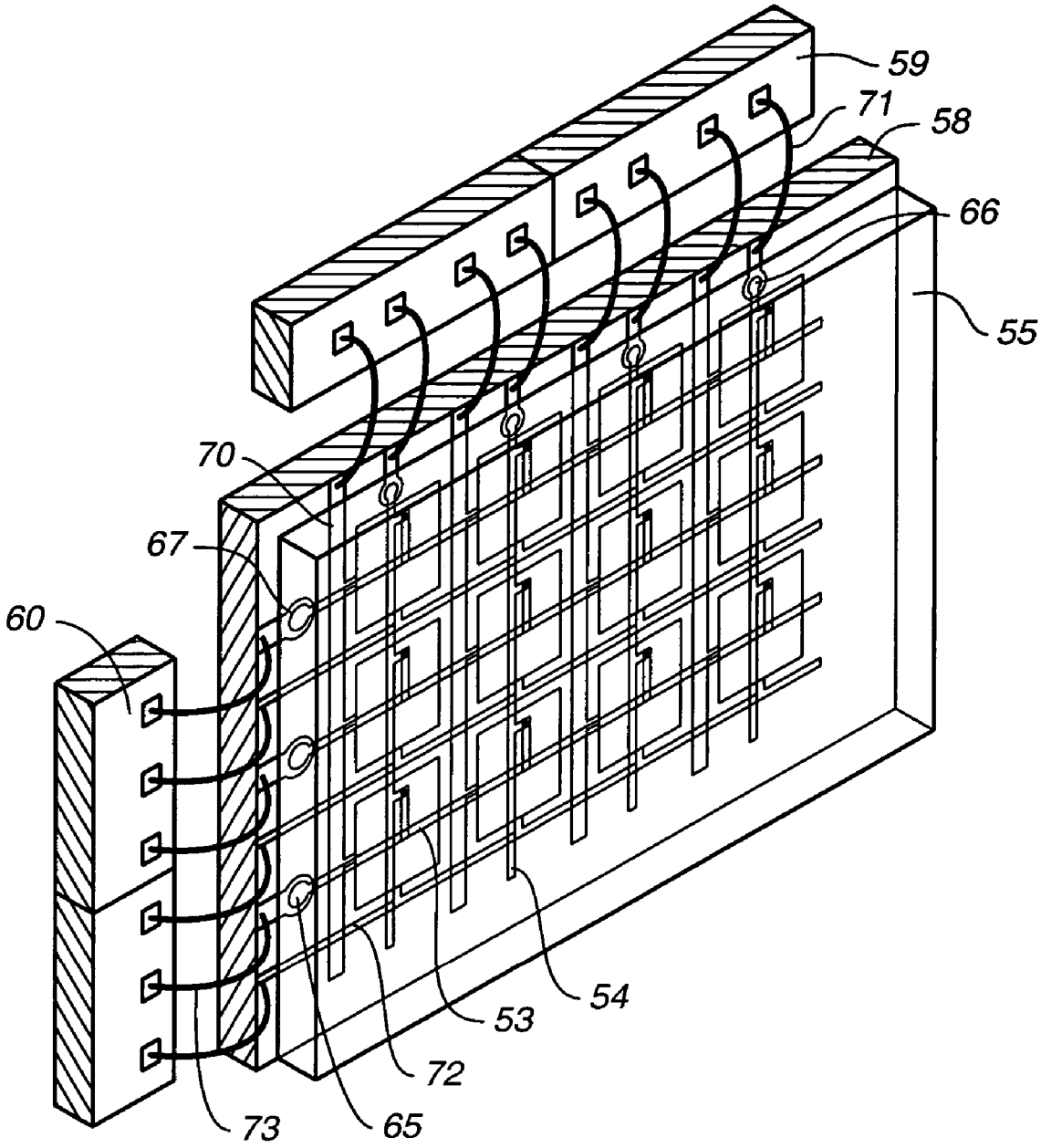
FIG. 5 is an illustration of a display according to an embodiment of the present invention.

Displays using sensor arrays as described with regard to FIGS. 3 and 4 may be assembled in a variety of ways. In one embodiment of the invention the row- and column-addressable array of sensors 11 is formed on a transparent substrate 55, such as glass, polymer, or other transparent substrate as illustrated in FIG. 5. The sensor element array consists of vertical parallel conducting lines 54 equal to the number of columns in the emissive display and horizontal conduction lines 53 equal to the number of rows in the display. At the junction of vertical and horizontal conduction lines is deposed sensors 11, as also shown in FIGS. 3–4.

Figure 6:
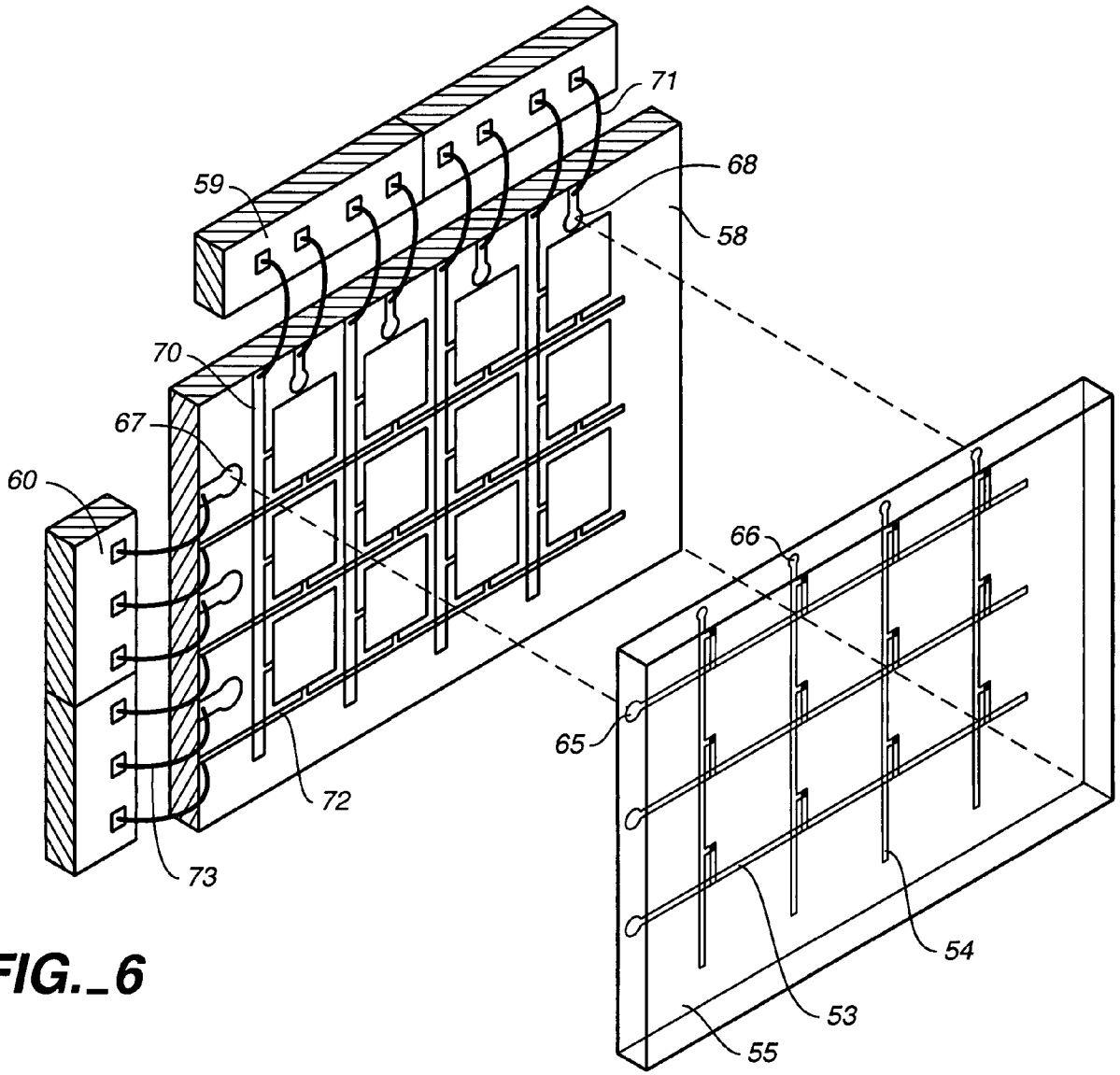
FIG. 6 is an illustration of a display according to an embodiment of the present invention.

FIG. 6 shows an exploded drawing of an array of light sources 58 coupled to a column integrated circuit (IC) 59, which may include the circuitry indicated in FIGS. 3A–C. The column IC 59 is operable to apply image data to and receive sensor data from sensors and light sources in each column. The light source array 58 is further coupled to a row selector 60, which may contain the circuitry indicated in FIGS. 3A–C. The row selector is operable to select a row for writing image data and/or reading sensor parameter values. The light source array 58 is positioned to illuminate the sensor array 55. Dotted lines in FIG. 5 indicate the electrical contact pads 66 and 65 on optical resistor array 55 may be aligned with electrical contact pads 67 and 68 on display 58. In FIG. 6 optical resistor array 55 is in contact with display 58. In one embodiment, column electrical lines 70 and 54 are connected to column IC 59 with wire bonds 71, and row electrical lines 53 and 72 are connected to row selector 60 through wire bonds 73. In another embodiment of the invention each sensor array 55 and display 58 could have separate cables attached to them that would connect to a printed circuit board (PCB), which also had row selector 60 and column IC 59 attached. Other connection means and methods as are known in the art may also or alternatively be used.

As described above, the sensors 11 are calibrated to determine the relationship between incident radiation level and measurable sensor parameter value. Referring to the sensor array embodiments in FIGS. 3A–C, one embodiment of a procedure for calibrating the optical resistors 11 proceeds as follows. A uniform or substantially uniform light source adjustable to each level of brightness desired for the calibration is projected onto an area of the optical resistor array. The quality of the calibration is effected by the uniformity of the light source, so the light source should be as uniform as required by the desired accuracy level of the calibration. In one embodiment, a sensor array is calibrated by overlaying the optical array on a backlight such as used in LCD laptops. This would give the optical array the same uniformity of the backlight, which would be sufficient for laptop applications, but may not be sufficient for say, 4096, levels (12-bit) of grayscale. Such applications may use a light source of uniformity across the active area of at least about 0.025%. This high degree of light uniformity is available from amongst commercially available devices and methods on the market.

Figure 7:
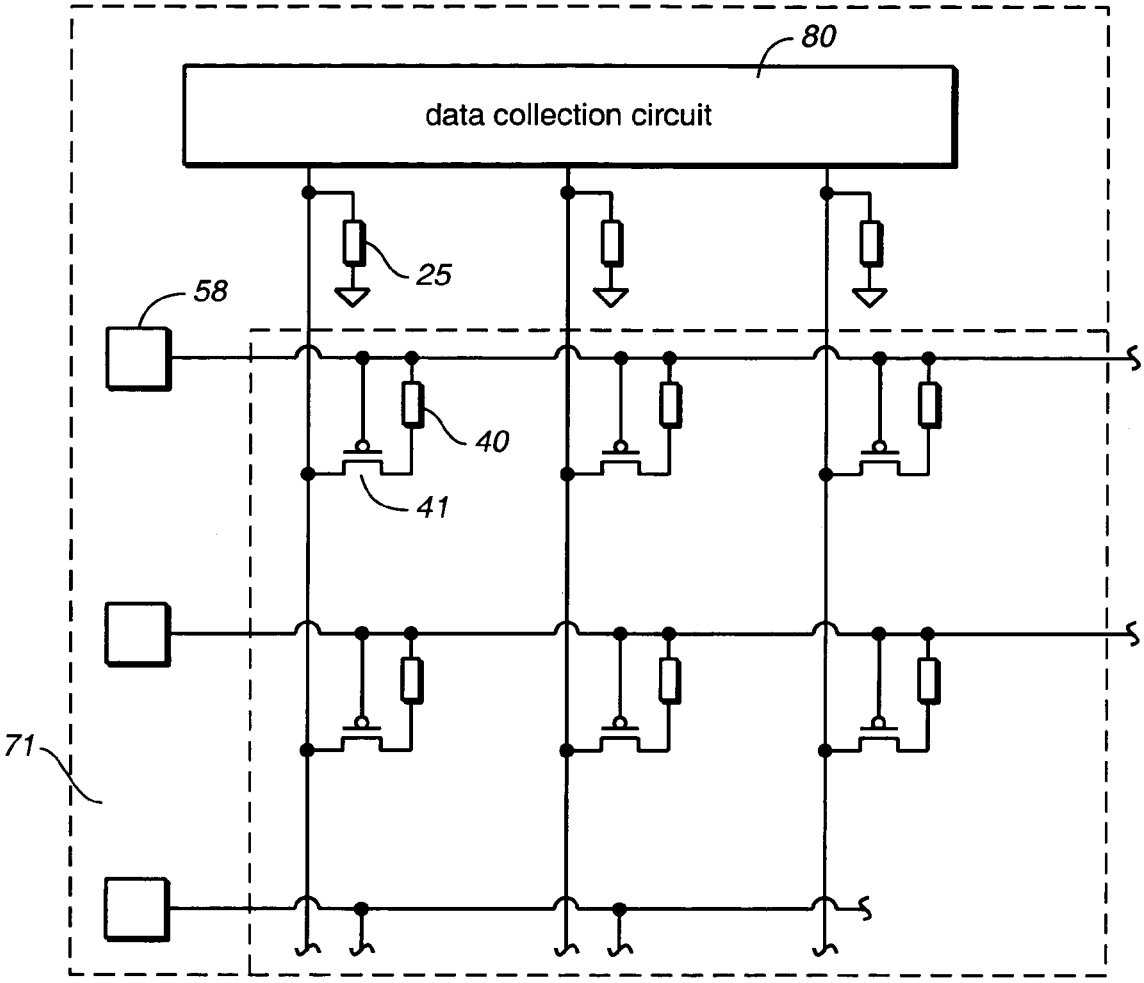
FIG. 7 is an illustration of a sensor array having a data collection circuit according to an embodiment of the present invention.

Once the first level of the grayscale illuminates the optical array, the optical resistors 11 in the array are scanned line by line (or according to some other scheme) at a known voltage supplied by voltage source 58, see FIG. 7, and current from which the resistance of the optical resistor is easily calculated. These resistance values are stored in memory using data collection circuit 80. The array is again scanned with the illumination turned up to the next value and the resistance values and again stored. This operation is repeated until the full grayscale from the darkest to the brightest has been completed. In some embodiments, only one value may be stored. In other embodiments, 5 resistance values are stored. In other embodiments 4096 values are stored. In other embodiments other numbers of resistance values may be stored. In generally any number of resistance values from one up to the number of discernable gray scale, brightness, or color values may be used and furthermore (though having little practical benefit) even more resistance values than the number of discernable gray scale, brightness, or color values may be used. The resultant values are stored in a look-up table or other memory data structure. Values not specifically stored in the look-up table may be interpolated from one or more stored values. Each optical array manufactured may be serialized and the look-up data stored on a website in association with the serialized number. Other association schemes may be used to communicate the look-up table for each sensor array—including bar codes, memory stored on or with the array, transmitting the look-up table to a receiver located in communication with the array, and still other embodiments provide the data in other ways. When the optical array is mated with, matched to, or otherwise identified with a display the look-up table data is downloaded from the website (or other source) to the memory chip to be used with the display, for example.

In one embodiment, the time it would take to scan 1000 levels of gray would be about 10 seconds at 100 frames per second. This procedure will give an optical response curve for each element in the optical array. There would be no need to have a gamma correction system in the display. Variance in optical response in the semiconductor used for the optical resistor would be accounted for. Different wavelength light sources, such as red, green, and blue light sources, may be calibrated separately.

The methods and apparatuses according to embodiments of the present invention find use in a variety of applications. Preferred embodiments of displays may be utilized in automotive applications, such as navigation or audio/visual displays, tuner displays, odometer and speedometer displays. Other applications include television display screens (particularly large TV display screens such as those having a picture diagonal larger than 30 inches), computer monitors, large screen scientific information or data displays, cellular phones, personal data assistants, and the like.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A method of controlling an array of pixels in an active matrix display to a predetermined emission level, the pixels arranged in a plurality of rows and a plurality of columns, each pixel having an active matrix element, the method using a plurality of sensors each having a measurable sensor parameter and at least one pixel driver, the method comprising:

varying light emission from a plurality of pixels in a first row using the at least one pixel driver and the active matrix elements;

receiving light emission from the plurality of pixels at the plurality of sensors;

obtaining a measured value of the measurable sensor parameter for each of the plurality of sensors responsive to the received light emission; and for each of the plurality of pixels, generating a control signal for the pixel to maintain constant emission from the light source at the predetermined emission level.

2. A method according to claim 1, wherein each of the plurality of pixels include a light source.

3. A method according to claim 1, wherein the at least one pixel driver provides a voltage to each of the plurality of pixels.

4. A method according to claim 1, wherein the plurality of pixels are pixels of a liquid crystal display.

5. A method according to claim 2, wherein the light source includes a light emitting diode.

6. A method according to claim 2, wherein the light source includes a white light emitting diode.

7. A method according to claim 2, wherein the light source includes an organic light emitting diode, electroluminescence, plasma emission, field emission, or vacuum florescence.

8. A method according to claim 1, wherein each of the plurality of sensors include a light-sensitive resistor, optical diode, or optical transistor.

9. A method according to claim 1, wherein at least one of the plurality of sensors includes a light-sensitive resistor and the measurable sensor parameter includes a voltage across the resistor.

10. A method according to claim 1, further comprising comparing the measured value to a reference value of the measurable sensor parameter, the reference value indicative of the predetermined emission level.

11. A method according to claim 10, wherein the reference value is an image voltage.

12. A method according to claim 11, further comprising calibrating the sensor to determine the reference value.

13. A method according to claim 12, wherein the act of calibrating the sensor comprises illuminating the sensor with a calibration light source.

14. A method according to claim 2, wherein the light source is an organic light emitting diode and the act of generating a control signal includes increasing a current through the light emitting diode.

15. A method according to claim 10, wherein the act of comparing the measured value with the reference value includes coupling the measured value and the predetermined value to a comparator.

16. A method according to claim 1, wherein the pixel driver provides a varying signal to the pixel to cause increasing light emission from the pixel and wherein the act of generating a control signal comprises replacing the varying signal with a constant signal to cause stable light emission from the pixel.

17. A method according to claim 16, wherein the varying signal comprises a ramp signal.

18. A method according to claim 17, wherein the ramp signal comprises a voltage ramp.

19. A method according to claim 17, wherein the ramp signal comprises a step voltage.

20. A method according to claim 1, further comprising: receiving image data including a desired emission level for the plurality of pixels in a first row, the image data including a target value for the measurable sensor parameter.

21. A method according to claim 20, further comprising comparing the value of the measurable sensor parameter of each sensor with the image data.

22. A method according to claim 1, further comprising repeating the acts of varying, receiving, obtaining and generating for a plurality of pixels in a second row.

23. An apparatus for controlling an active matrix display including an array of pixels arranged in a plurality of rows and a plurality of columns, each pixel element including an active matrix element, the apparatus comprising:

a sensor array arranged in a plurality of rows and a plurality of columns, each sensor having a measurable sensor parameter and positioned to receive at least a portion of the radiation emitted from at least one of the pixels;

a row selector coupled to the sensor array and coupleable to the display operable to select at least one of the plurality of rows; and a plurality of control units, each coupled to a plurality of the sensors located in a common column and a reference signal indicative of a target value of the measurable sensor parameter for a pixel in the selected row, the control unit operable to compare a measured value of the sensor parameter with the reference signal and generate a control signal, the control unit further coupled to the active matrix elements such that the active matrix elements receive the control signal and maintain the amount of radiation emitted from the light source.

24. An apparatus according to claim 23, the plurality of control units each further coupled to a reference signal indicative of the value of the measurable sensor parameter during the predetermined emission level for each of the pixels in the selected row, the control unit operable to compare the reference signal and the measured value.

25. An apparatus according to claim 23, further comprising a calibration look-up table coupled to the control units, the calibration look-up table storing at least one value of the measurable sensor parameter indicative of the predetermined emission level.

26. An apparatus according to claim 25, further comprising a line buffer coupled to the look-up table and the control units.

27. A controlled active matrix display, comprising:

an array of pixels arranged in a plurality of rows and a plurality of columns, each pixel element including an active pixel element configured to drive the pixel;

a sensor array arranged in the plurality of rows and the plurality of columns, each sensor having a measurable sensor parameter and positioned to receive at least a portion of the radiation emitted from at least one of the pixels;

a row selector coupled to the sensor array and the array of pixels and operable to select at least one of the plurality of rows;

a plurality of control units, each coupled to a plurality of the sensors located in a common column and a reference signal indicative of a target value of the measurable sensor parameter for a pixel in the selected row, the control unit operable to compare a measured value of the sensor parameter with the reference signal and generate a control signal; and a pixel driver coupled to the active matrix elements, the pixel driver coupled to the active matrix elements and operable to vary an amount of radiation emitted from at least one pixel, the active matrix elements operable to receive the control signal and maintain the amount of radiation emitted from the pixel.

28. A controlled active matrix display according to claim 27, wherein the pixel driver provides a varying signal to the active matrix elements.

29. A controlled active matrix display according to claim 27, wherein the control units are further coupled to a reference signal indicative of a predetermined emission level, the control unit further operable to compare the measured value of the measurable sensor parameter with the reference signal to determine the predetermined emission level is attained.

30. A controlled active matrix display according to claim 27, wherein said sensor includes a photo-sensitive resistor, diode, or transistor.

* * * * *